US010378719B2

(12) United States Patent
Taudt et al.

(10) Patent No.: US 10,378,719 B2
(45) Date of Patent: Aug. 13, 2019

(54) LIGHTING DEVICE HAVING LIGHT-GUIDING SHIELD

(71) Applicant: ZKW Group GmbH, Wieselburg (AT)

(72) Inventors: Lukas Taudt, Wieselburg (AT); Bettina Reisinger, Amstetten (AT); Andreas Moser, Haag (AT)

(73) Assignee: ZKW Group GmbH, Wieselburg (AT)

( * ) Notice: Subject to any disclaimer, the term of this patent is extended or adjusted under 35 U.S.C. 154(b) by 23 days.

(21) Appl. No.: 15/559,886

(22) PCT Filed: Apr. 4, 2016

(86) PCT No.: PCT/AT2016/050088

§ 371 (c)(1),
(2) Date: Sep. 20, 2017

(87) PCT Pub. No.: WO2016/161471

PCT Pub. Date: Oct. 13, 2016

(65) Prior Publication Data

US 2018/0058652 A1 Mar. 1, 2018

(30) Foreign Application Priority Data

Apr. 10, 2015 (AT) ..... A 50284/2015

(51) Int. Cl.
*F21S 41/43* (2018.01)
*F21S 41/143* (2018.01)
(Continued)

(52) U.S. Cl.
CPC ..... *F21S 41/43* (2018.01); *F21S 41/143* (2018.01); *F21S 41/24* (2018.01); *F21S 41/25* (2018.01); *F21S 41/255* (2018.01)

(58) Field of Classification Search
CPC ..... F21S 41/143; F21S 41/24; F21S 41/25; F21S 41/255; F21S 41/40; F21S 41/43
See application file for complete search history.

(56) References Cited

U.S. PATENT DOCUMENTS 4,562,519 A * 12/1985 Deves ..... F21S 48/1258 362/308
7,175,323 B2 * 2/2007 Bucher ..... F21V 9/04 362/539
(Continued)

*Primary Examiner* — Peggy A Neils
(74) *Attorney, Agent, or Firm* — Eversheds Sutherland (US) LLP

(57) ABSTRACT

The invention relates to a lighting device (1) for a motor vehicle headlight, comprising a light module (2) with at least one light emission source (10), a primary lens (100) and a secondary lens (300), wherein said primary lens (100) comprises at least one light-conducting ancillary lens (102) which is designed to direct light (50) captured by the at least one light emission source (10) through at least one light-emitting surface (103) of the ancillary lens and on to the secondary lens (300) arranged downstream in optical longitudinal axial direction (150), and wherein the secondary lens (300) is designed to image a light distribution, which forms on the light-emitting surface (103) of the ancillary lens, in an area in front of the lighting device (1). At least one light-guiding shield (200) for shading a light color fringe (250) is arranged between the primary lens (100) and the secondary lens (300), wherein the at least one light-guiding shield (200, 201, 202) forms an optically active first aperture edge (221) for a lower light color fringe (252) and an optically active second aperture edge (222) for an upper light color fringe (251), and the optically active aperture edges (220, 221, 222) are each arranged in such a manner in the light beam (50) that blue defining light beams (51) of the light color fringe (250, 251, 252) can be selectively shaded.

20 Claims, 8 Drawing Sheets

(51) Int. Cl.

| | |
|---|---|
| ***F21S 41/24*** | (2018.01) |
| ***F21S 41/255*** | (2018.01) |
| ***F21S 41/25*** | (2018.01) |

(56) References Cited

U.S. PATENT DOCUMENTS

| | | | | |
|---|---|---|---|---|
| 8,070,339 | B2 * | 12/2011 | Koike | F21S 41/275<br>362/538 |
| 8,899,782 | B2 * | 12/2014 | Sikkens | F21V 13/04<br>362/235 |
| 9,228,711 | B2 * | 1/2016 | Park | F21S 41/143 |
| 9,423,089 | B2 * | 8/2016 | Lee | F21S 41/295 |
| 2015/0316223 | A1 * | 11/2015 | Ziegler | F21S 41/14<br>362/510 |

* cited by examiner

LIGHTING DEVICE HAVING LIGHT-GUIDING SHIELD

The invention relates to a lighting device for a motor vehicle headlight, comprising a light module with at least one light emission source, a primary lens and a secondary lens, wherein said primary lens comprises at least one light-conducting ancillary lens which is designed to direct light captured by the at least one light emission source through at least one light-emitting surface of the ancillary lens and on to the secondary lens arranged downstream in optical longitudinal axial direction, and wherein the secondary lens is designed to image a light distribution, which forms on the light-emitting surface of the ancillary lens, in an area in front of the lighting device.

It is known from the prior art that, when light beams are dispersed in an optical lens or an optical lens system, short-wave electromagnetic radiation is refracted more strongly than long-wave radiation at an emission surface of the optical system. Depending on the interaction with the corresponding optical medium, with polychromatic light, this can result in an unwanted splitting of blue and red light portions, particularly in the edge areas of the optical lenses because short-wave blue light portions are refracted more strongly than green ones and these in turn are refracted more strongly than comparatively long-wave red light portions.

The refraction index of lenses of an optical system furthermore influences the imaging scale which is thus dependent on the wavelength of the light. Refraction index differences between the lens material as object space and the surrounding medium air as image space result in different imaging scales for blue and red light portions due to the wavelength dependence of the refraction index. Partial images formed from light with different wavelength are thus of a different size. This effect is called lateral chromatic aberration, causing color fringes at the edges of an image motif if they do not run radially, thus effecting a blurring of the image. The width of the color fringes of the image motif is proportional to the distance from the image center.

The focal length of the optical system and thus the distance of the image from the last surface of the optical system are dependent on the refraction index of the lenses and thus on the wavelength of the light. This effect is called longitudinal chromatic aberration. As a result, the partial images of different colors cannot be captured in focus simultaneously because they are located at different positions. For example, red color fringes lie in front of the selected focal plane, blue color fringes lie behind it. This results in blurring which does not depend on the image height.

In order to preferably avoid such imaging errors, also called aberrations, which prevent the creation of a perfect pixel when imaging an object point, a compromise must be found between the requirements for the desired optical imaging quality and the design effort when designing optical systems in general, particularly headlights for motor vehicles.

From document EP 2 306 074 A2, a motor vehicle headlight with a secondary lens is known which comprises an achromatically acting arrangement of two lenses with different refractive or different refraction index. By means of the achromatic lens combination of a diverging lens and a collecting lens, unwanted color fringes are removed. In addition, reflecting and/or absorbing aperture surfaces are arranged between a light source or a primary lens and the secondary lens such that misguided light oriented in adjacent irradiation directions outside the main beam direction is prevented from influencing the light distribution in the area in front of the headlight. This design is disadvantageous at the very least because the achromatic lens arrangement of the secondary lens is elaborate and due to the use of aperture surfaces on the sides, the overall efficiency of the headlight is reduced.

In document DE 601 31 600 T3, a projection headlight with ellipsoidal reflector for motor vehicles is described, which is designed to generate a high beam. It is the intention of this headlight to generate a light field in the area in front of the headlight, and said light field gradually becomes weaker, the closer the road areas to be illuminated in front of the headlight are. In addition, unwanted colorings of the light are supposed to be prevented. For that purpose, a light-guiding shield is arranged between a light source with a reflector, which is roughly configured as a rotational ellipsoid, and a collecting lens such that the entire light-guiding shield is located above the horizontal plane, which contains the optical axis, and in which the focal ranges of the reflector or the focal point of the collecting lens lie. For that purpose, the light-guiding shield comprises an edge profile with at least two shading areas, each forming one edge, which are spaced apart from one another in the direction of the optical axis, wherein either one of the edges is arranged perpendicularly to a focal point of the collecting lens, or the edges are arranged behind or in front of the focal point of the lens in the direction of the optical axis. For that purpose, a first front shading area protrudes with its marginal edge into the upward oriented light beam path while a second shading area, arranged downstream in the direction of the optical axis, protrudes with its marginal edge into the downward oriented light beam path. The focal point of the collecting lens is located near the second focal range of the reflector.

For the arrangement of a light-guiding shield in the beam path between a primary lens and a secondary lens, it generally applies that the positioning of the light-guiding shield is more insensitive to tolerances at a greater distance from the primary lens because a distance normal to the horizontal plane between a split red and blue light beam is greater in the marginal fringe of the light beam. This design described in DE 601 31 600 T3 is disadvantageous at the very least because the position of the light-guiding shield relative to the lens focal point or the focal range of the reflector is predetermined and the position of the light-guiding shield can thus only be adjusted to different lighting tasks in an insufficient manner. Since one and the same light-guiding shield protrudes both into the downward and upward oriented light beam, the light-guiding shield, in order to effectively shade unwanted marginal fringes or stray light, must protrude comparatively far into the light beam cone, thus disadvantageously diminishing the efficiency of the headlight.

From document U.S. Pat. No. 7,036,969 B2, a car light with a specific shield geometry is known, which is intended to minimize the stray light formation of an adverse weather headlamp and to avoid glare. For this purpose, the edge profile of a foreground shield has a central area, side areas, and an upper area which together form a triangle. The avoidance of chromatic aberrations is neither intended nor planned. With this design, it once again cannot be avoided that the shield geometry diminishes the efficiency of the optical system.

Tests on motor vehicle headlights that comprise so-called "imaging light modules" with a primary lens and a secondary imaging lens, for example, the so-called PixelLite or MatrixLight systems known from literature, have shown that particularly the blue light portions in the color fringe of the headlight must be avoided because in the area of the foreground, especially in the lower area of the light distribution, i.e. below the line of the horizon, the so-called HH line, they are clearly noticeable by the driver and as an unpleasantly irritating play of colors disrupt a desired light distribution. The color fringes are also noticed as irritating because they stand out from the "white" light distribution of the foreground. The foreground is frequently generated by means of a color-neutral reflector module.

The problem addressed by the present invention is therefore that of improving a lighting device of the type in question for a motor vehicle headlight such that the described disadvantages of the prior art are avoided as much as possible and that the interfering effects of color fringes are reduced and an overall efficiency or light yield is simultaneously increased with the lighting device.

According to the invention, this problem is solved for a lighting device of the type in question by the features in the characterizing part of patent claim 1. Particularly preferred embodiments and developments of the invention are subject matter of the dependent claims.

In a lighting device according to the invention for a motor vehicle headlight, comprising a light module with at least one light emission source, a primary lens and a secondary lens, wherein said primary lens comprises at least one light-conducting ancillary lens which is designed to direct light captured by the at least one light emission source through at least one light-emitting surface of the ancillary lens and on to the secondary lens arranged downstream in optical longitudinal axial direction, and wherein the secondary lens is designed to image a light distribution, which forms on the light-emitting surface of the ancillary lens, in an area in front of the lighting device, at least one light-guiding shield for shading a light color fringe is arranged between the primary lens and the secondary lens, wherein the at least one light-guiding shield forms an optically active first aperture edge for a lower light color fringe and an optically active second aperture edge for an upper light color fringe, and the optically active aperture edges are arranged in such a manner in the light beam that selective blue defining light beams of the light color fringe can be shaded.

Within the scope of the invention, shorter-wave, blue defining light beams are light beams with a radiation in a wavelength range from 405 nm to 480 nm. For example, a laser diode has an emission wavelength of approximately 405 nm, said laser diode also being able to be used for a lighting device within the scope of the invention. For that purpose, for example, segmented phosphorus elements are applied to the entry surfaces and excited by appropriate laser diodes. White-light LEDs also have a primary emission at wavelengths of approximately 450 nm.

Particularly advantageously, the light-guiding shield in a lighting device according to the invention is arranged such that the blue defining light beams of the light color fringe are selectively shaded because particularly the blue light portions in the color fringe of the headlight in the area of the foreground are clearly noticeable by the driver and as an unpleasantly irritating play of colors disrupt a desired light distribution. In a particularly advantageous embodiment, the at least one light emission source is assigned to one entry surface of a specific ancillary lens and dimmable. Therefore, different lighting tasks can be accomplished by the lighting device in a flexible manner.

Expediently, the optically active aperture edges are arranged in the light beam in a lighting device according to the invention such that red defining light beams can reach the secondary lens without shading. In this design of the invention, the light-guiding shield is arranged such that red defining light beams, the radiation of which lies in a wavelength range from 600 nm to 750 nm, can reach the secondary lens through the light-guiding shield with as little shading as possible. Tests in the foreground surprisingly showed that the red light portions in the color fringe of the headlight in the area of the foreground are, when compared to the blue light portions, barely noticeable by the driver and disrupt a desired light distribution significantly less than is the case with blue light portions. Advantageously, the overall efficiency or light yield of the headlight in this embodiment is only slightly reduced because the red light portions are shaded either not at all or only to the smallest possible degree.

However, it must be noted that the actual light beam path in the light-conducting ancillary lens comprises both direct light beams and light beams redirected one or multiple times, wherein their differential distance perpendicularly to the optical axis between the red and blue defining light beams is different. It must further be noted that the differential distance between the red and blue defining light beams also depends on the material of the light-conducting ancillary lens.

If the position of the optically active aperture edges, for example, is aligned by means of the light beam path of direct light beams, direct light beams, which have a smaller differential distance between the red and blue defining light beams perpendicular to the optical axis than light beams which are redirected multiple times, will reach the secondary lens without shading of their red defining light beams. However, a small component of red defining light beams of light beams which are redirected multiple times can possibly be prevented from passing through the light-guiding shield. Conversely, if the position of the optically active aperture edges, for example, is aligned or optimized by means of the light beam path of light beams which are redirected several times, light beams which are redirected several times, which have a greater differential distance between the red and blue defining light beams perpendicular to the optical axis than direct light beams, will reach the secondary lens without shading of its red defining light beams. However, in this case, to a slight extent, a shading of red defining light beams of the direct light beams can occur. For the positioning of the aperture edges, it is therefore required to find an optimum between a preferably complete shading of the blue defining light beams and an unimpeded passing of the red defining light beams through the shield.

Particularly advantageously, in a lighting device according to the invention, the optically active aperture edges protrude between the blue defining light beams and the red defining light beams of the light color fringe into the light beam. Advantageously, blue defining light beams in a wavelength range from 405 nm to 480 nm are selectively shaded by the light-guiding shield, while red defining light beams in a wavelength range from 600 nm to 750 nm pass through the light-guiding shield without shading.

In a particularly compact design of the invention, the at least one light-guiding shield in a lighting device can be arranged in an aperture plane substantially perpendicularly to the optical longitudinal axis. In this embodiment, the aperture edges of the light-guiding shield are located in one and the same aperture plane. The light-guiding shield can be designed so as to be one piece or multiple pieces. Preferably, the at least one light-guiding shield has smoothly continuing aperture edges without structured divisions, such as webs, frames, reinforcements, or the like because structured or segmentally compounded light-guiding shields with divided aperture edges are imaged disadvantageously as interfering stripes in the traffic area or on a road. Due to the arrangement of the light-guiding shield in an aperture plane, the adjustment of the light-guiding shield in the direction of the optical longitudinal axis is particularly simple.

In an advantageous embodiment of the invention, the light-guiding shield in a lighting device can be designed so as to be one piece, having an aperture recess which forms a continuous optically active aperture edge with a first aperture edge section for a lower light color fringe and a second aperture edge section for an upper light color fringe, wherein the aperture edge in mounted position encompasses the optical longitudinal axis. A single-piece light-guiding shield is particularly easy to produce and install within the lighting device. The single-piece light-guiding shield with a continuous, smoothly continuing aperture edge without structured divisions, such as webs or reinforcements, is further advantageous because the light distribution in the foreground of the lighting device is imaged without interfering stripes. In the event that a primary lens with a plurality of ancillary lenses or one ancillary lens with a plurality of light conductors is used, the continuous, smoothly continuing aperture edge is also advantageous because the light distribution of the entirety of all ancillary lenses or all light conductors is jointly projected through the one aperture recess, resulting in a particularly homogenous light distribution without interfering stripes due to the smoothly continuing aperture edge.

In a further advantageous embodiment, the light-guiding shield in a lighting device according to the invention can be designed to be a two-piece light-guiding shield, wherein a first aperture part with a first optically active aperture edge and a second aperture part with a second optically active aperture edge are arranged on opposite sides of the optical longitudinal axis. In this two-piece design of the light-guiding shield, the two optically active aperture edges can be adjusted particularly flexibly on the first or second aperture part to the geometric conditions of the beam path within a lighting device. As a result, the aperture edges can also be arranged asymmetrically with regard to a horizontal plane through the optical longitudinal axis. In this embodiment with a two-piece light-guiding shield, the two optically active aperture edges are also each preferably designed so as to be continuously smooth without structuring, webs or interruptions in order to ensure that the light distribution in the foreground of the lighting device is imaged without interfering stripes.

Expediently, in a further design of the lighting device according to the invention, the first aperture part and the second aperture part can be arranged in different aperture planes which are spaced apart from one another in optical longitudinal axial direction. In this embodiment of the invention, the aperture edges can be arranged particularly flexibly in the beam path of the light beam in order to selectively shade blue defining light beams of the light color fringe.

In an advantageous development of the invention, at least one optically active aperture edge can be a freeform curve. Since the geometries particularly of motor vehicle headlights are determined by numerous influencing factors, for example, by design guidelines, by specifications from authorities as well as design requirements by the motor vehicle manufacturers, it must be possible to also adjust the geometries of the aperture edges of the light-guiding shield to the corresponding geometric specifications of the respective motor vehicle headlight. This is accomplished most easily with an aperture edge designed as freeform curve. As already stated above, the at least one optically active aperture edge is preferably configured as smooth freeform curve, having no structuring such as webs or comparable interruptions. For determining or calculating such a smooth freeform curve, e.g. a spline interpolation can be used, with which predefined support points are interpolated with piecewise continuous polynomials, so-called splines, in order to advantageously achieve a smooth interruption-free curve shape.

In a lighting device according to the invention, the at least one light-guiding shield is in optical longitudinal axial direction preferably spaced apart from a lens focal point plane at a distance of 10% to 90%, preferably 30% to 70%, particularly preferably 50%, of a focal length distance between the lens focal point plane and a lens apex plane of the secondary lens. In this design, the light-guiding shield is attached between the lens focal point plane and the lens apex plane of the secondary lens.

For a lighting device according to the invention, it is particularly advantageous that the distance of the at least one light-guiding shield from the lens focal point plane can be determined by color sensor measurements and/or color simulation calculations as difference of the relative difference between a red light portion shaded by the light-guiding shield and the red light portion continuing without the light-guiding shield in the light beam, and the relative difference between a blue light portion shaded by the light-guiding shield and the blue light portion continuing without the light-guiding shield in the light beam, wherein an increased blue light portion is shaded in case of a positive difference, and an increased red light portion is shaded by the light-guiding shield in case of a negative difference. In this embodiment, for an aperture position of the light-guiding shield advantageously selected at a specific distance from the lens focal point plane in the direction of the optical longitudinal axis, the relative differences between shaded red light portions or blue light portions due to shading of the corresponding light portions at the light-guiding shield and the red light portions or blue light portions without light-guiding shield are determined through color sensor measurements. For that purpose, the light-guiding shield or the aperture edges of the light-guiding shield, each with different standard intervals to the optical axis, are each examined from the direction of the optical longitudinal axis at the same distance of the light-guiding shield from the lens focal point plane, and an optimal position for each of the aperture edges with regard to the efficiency of the lighting device to selectively shade blue defining light beams is determined. Through iteration from the direction of the optical longitudinal axis of the distance of the light-guiding shield from the lens focal point plane, these relative measurements are repeated for different distances from the lens focal point plane. It is thus possible by means of test measurements to determine a course of the difference of the relative difference between a red light portion shaded by the light-guiding shield and the red light portion continuing without the light-guiding shield in the light beam, and the relative difference between a blue light portion shaded by the light-guiding shield and the blue light portion continuing without the light-guiding shield in the light beam as function of the distance of the light-guiding shield from the lens focal point plane from the direction of the optical longitudinal axis.

In addition or alternatively to the above described "rear" measurement method on a real prototype of a headlight, "virtual" measurements by means of simulation calculation are increasingly conducted in practice. For such "virtual" determinations or calculations, for example a Raytrace® simulation program is used.

The preferred distance of each of the light-guiding shield or the aperture edges of the light-guiding shield normal to the optical longitudinal axis is determined as compromise between the desired shading of the blue defining light beams and the overall efficiency of the lighting device to be achieved. Since greater shading also lowers the overall efficiency of the lighting device, the corresponding position of the light-guiding shield must thus be selected such that the shaded blue light portion is greater than the portion of shaded red defining light beams.

In a preferred embodiment of the invention, the value of the difference of the relative difference between a red light portion shaded by the light-guiding shield and the red light portion continuing without the light-guiding shield in the light beam, and the relative difference between a blue light portion shaded by the light-guiding shield and the blue light portion continuing without the light-guiding shield in the light beam is 0.1 to 02 in a lighting device for distances of 20 mm to 25 mm of the light-guiding beam from the lens focal point plane in the direction of the optical axis. With determined positive differences with values of 0.1 to 0.2, an increased blue light portion is advantageously selectively shaded, wherein the overall efficiency of the lighting device still remains high.

Expediently, in a lighting device according to the invention, the at least one light-guiding shield is, together with the primary lens, attached to a primary lens holder. In this design, the light-guiding shield and the primary lens are particularly conveniently jointly attached.

In a particularly compact embodiment of the invention, the at least one light-guiding shield in a lighting device is integrated in the primary lens. In addition to the advantages of a particularly compact design of the unit comprising primary lens and light-guiding shield, the light-guiding shield cannot inadvertently adjust its position relative to the primary lens, which is a further advantage of this design.

An advantage in a lighting device according to the invention is a differential distance between a blue defining light beam and a red defining light beam transversely to the optical longitudinal axis, depending on the distance in optical longitudinal axial direction and depending on the material of the light-conducting ancillary lens. Tests have shown that, for example, in polycarbonate as light-conducting material, a particularly significant color split is distinctive, i.e. particularly large differential distances between blue and red defining light beams occur with polycarbonate. Due to the large differential distances transversely to the optical longitudinal axial direction, a selective shading of blue defining light beams is thus particularly easy with a light-conducting ancillary lens made of polycarbonate.

Expediently, the secondary lens in a lighting device according to the invention comprises a projection lens with a lens entry surface, which can be formed to be flat or spherical, and a frequently aspherical lens emission surface. Advantageously, this design of a lighting device according to the invention can be used in headlights with imaging optics. The light modules of such headlights are usually called light modules with ancillary lens and downstream projection lens.

In a development of the invention, the lighting device is designed to generate a low beam or high beam distribution. Advantageously, with a lighting device with the at least one light-guiding shield, a low beam or high beam distribution can optionally be achieved, in which blue defining light beams are selectively shaded in the light color fringe. The switch between low beam and high beam is usually effected by a corresponding design of the combination of one or more light sources with the ancillary lens.

The invention further comprises a motor vehicle headlight with at least one lighting device according to the invention. Advantageously, motor vehicle headlights with a lighting device according to the invention are thus provided, which allow for a particularly "white" or color-neutral light distribution of the illuminated foreground without interfering blue color light fringes. Motor vehicle headlights equipped with the lighting device according to the invention are thus perceived to be of particularly high value due to their even, color-neutral light distribution.

In addition, a motor vehicle with a least one motor vehicle headlight equipped with at least one lighting device according to the invention can also be indicated to be within the scope of the invention. The above-mentioned advantages of the lighting device according to the invention thus also apply to the motor vehicle equipped with the at least one motor vehicle headlight.

Further details, features; and advantages of the invention result from the following description of an embodiment schematically depicted in the drawing.

Figure 5:
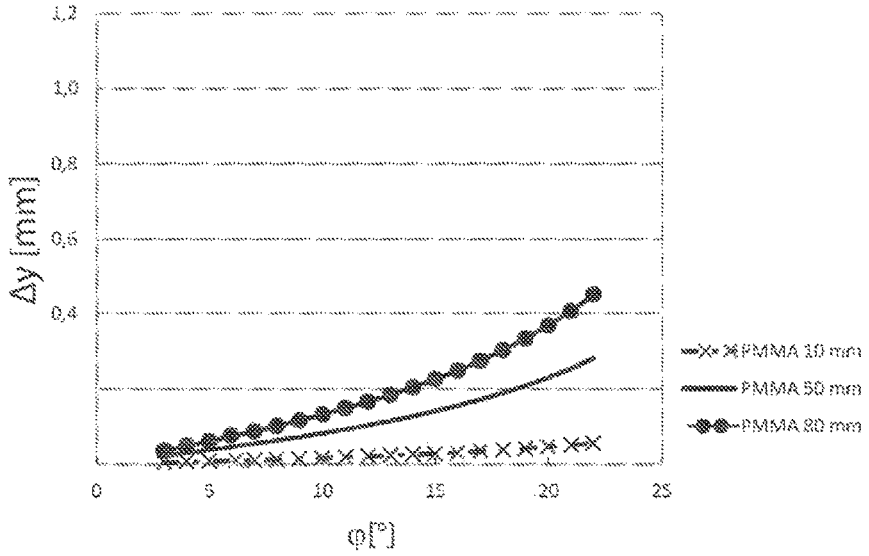
Figure 6:
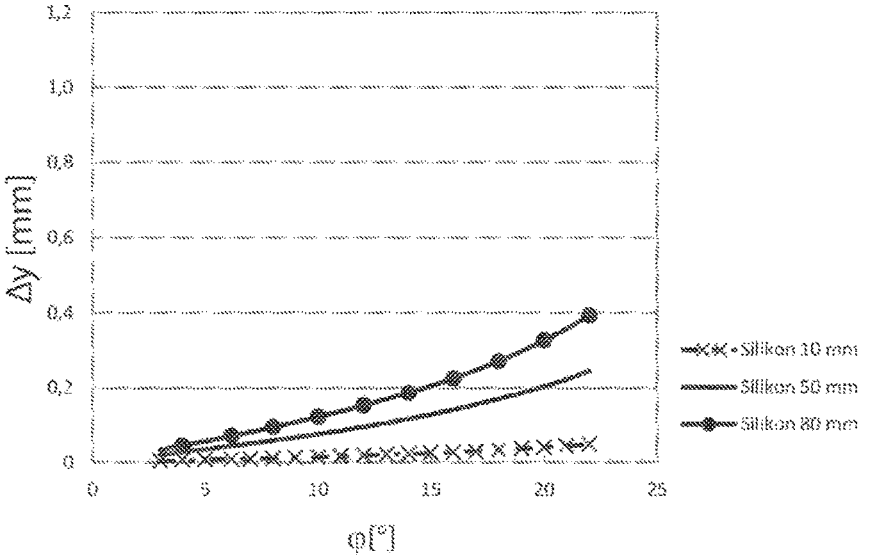
Figure 7:
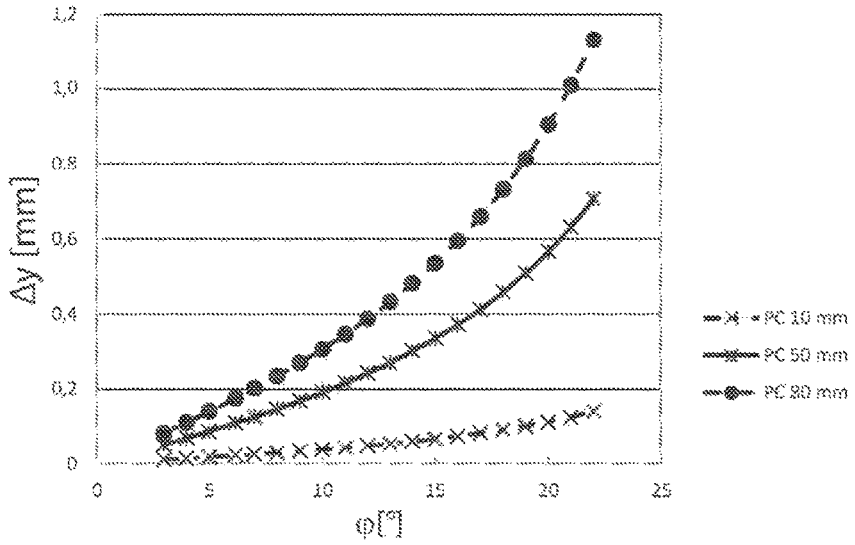
Figure 8:
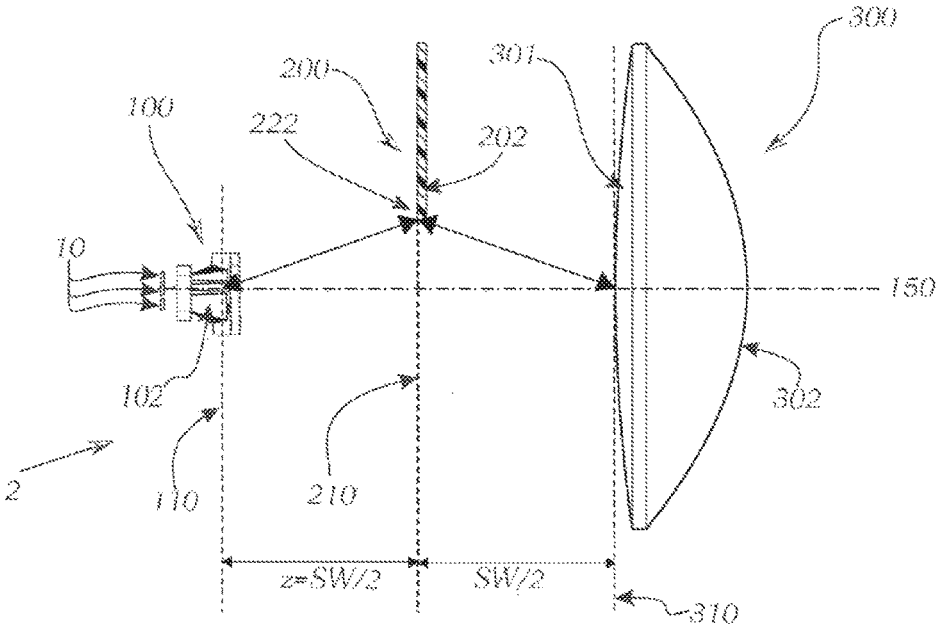
Figure 9:
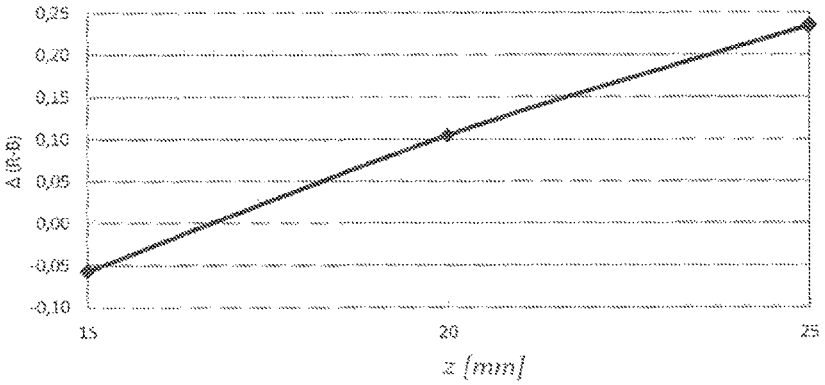
Figure 10:
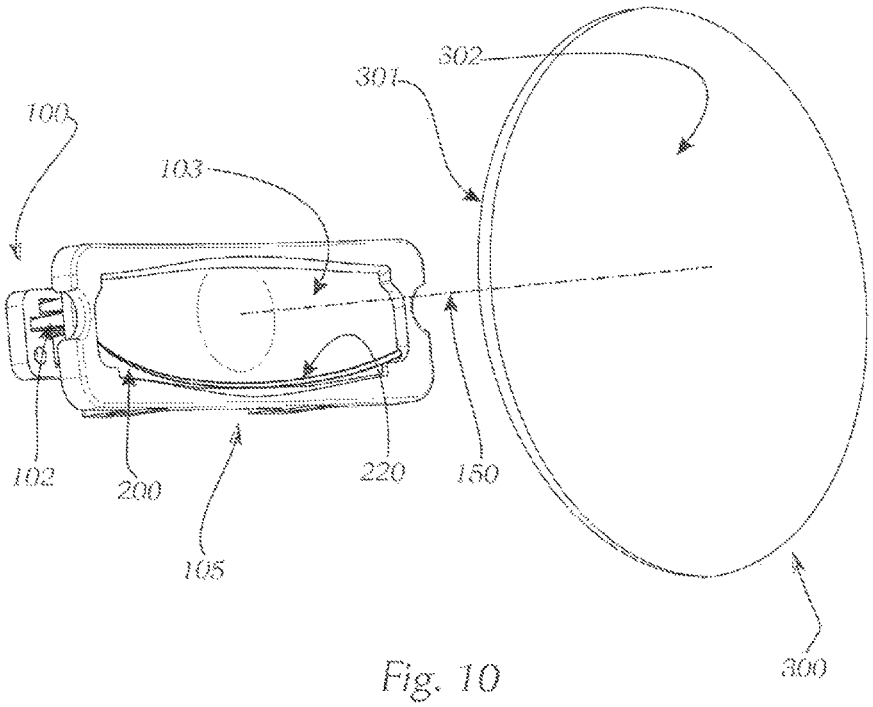
Figure 11:
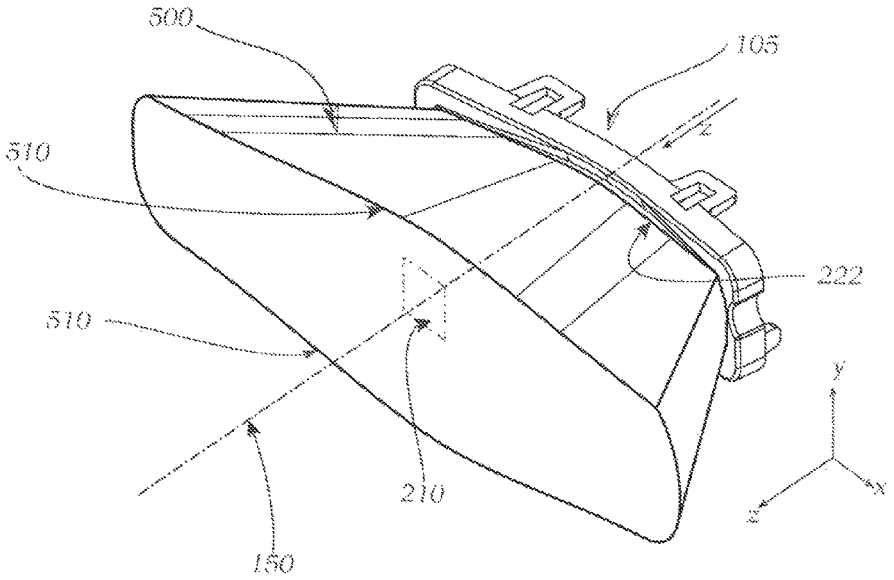
Figure 12:
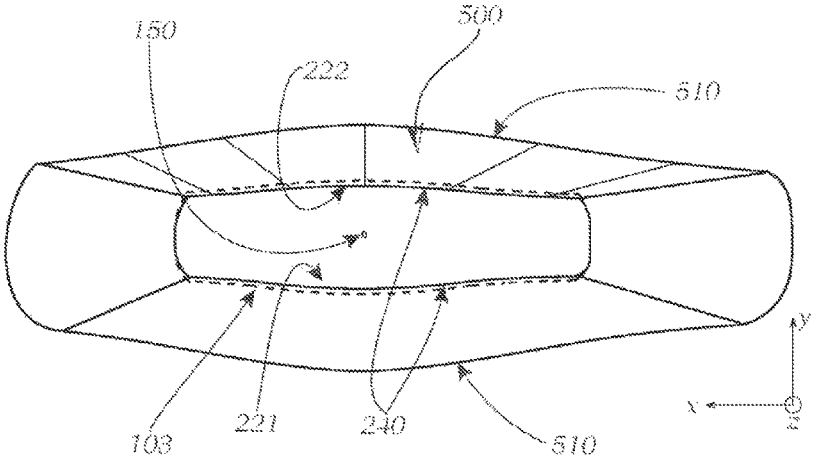
Figure 13:
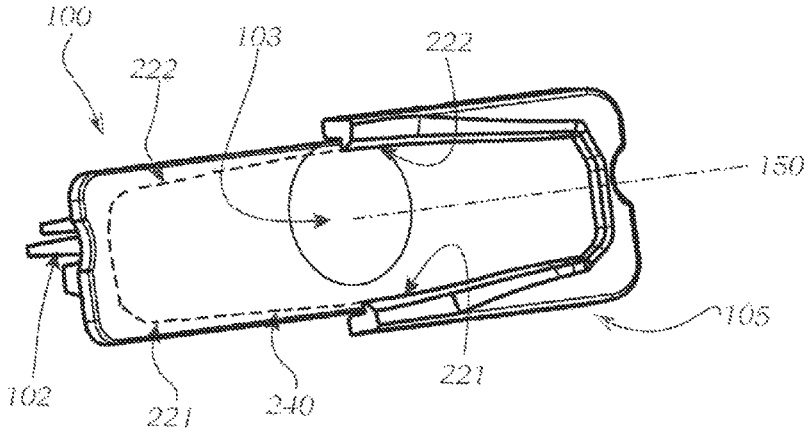
Figure 14:
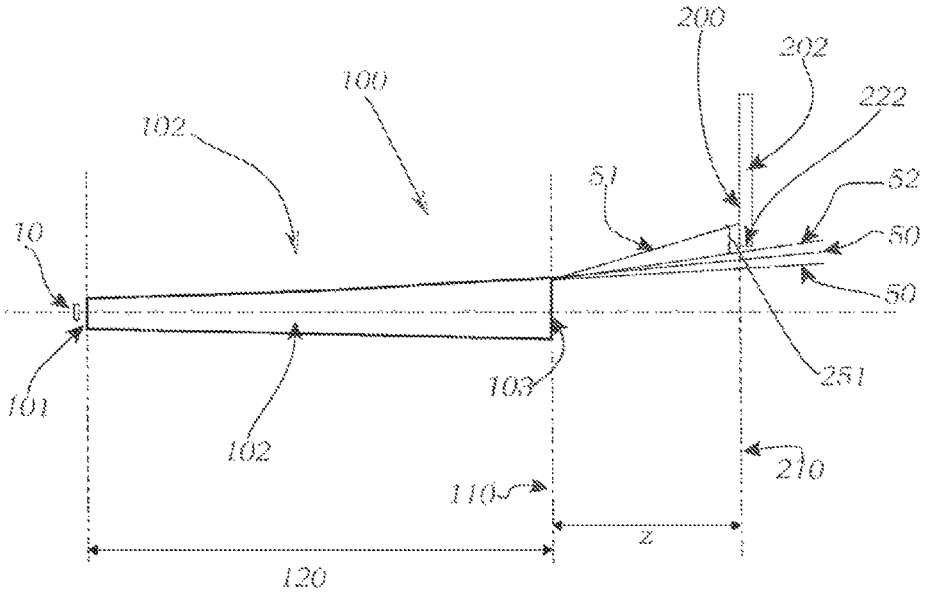

FIGS. 5 to 7 each show as diagram representation for different materials of the light-conducting ancillary lens the course of the differential distance $\Delta\gamma$ between defining light beams as function of the angle $\varphi$ between optical axis and defining light beam;

FIG. 8 shows a side view of a lighting device according to the invention with an aperture position of the light-guiding shield at half the focal length;

FIG. 9 shows a diagram representation of the course of the selection criterion $\Delta(R-B)$ as a function of the distance z of the light-guiding shield from the lens focal point plane for determining a suitable aperture position in the beam path;

FIG. 10 shows in a schematic isometric view from the side an alternative position of a color-correcting light-guiding shield as part of the ancillary lens holder;

FIG. 11 shows an isometric view at an angle from above the color-correcting light-guiding shield shown in FIG. 10 as part of the ancillary lens holder;

FIG. 12 shows a front view of the arrangement shown in FIG. 11;

FIG. 13 shows in a partial sectional view at an angle from the side the course of the aperture edges in the example shown in FIGS. 10 to 12, including primary lens holder;

FIG. 14 shows in a detailed view from the side the shading of defining light beams of a light beam directly guided in the ancillary lens.

Figure 1:
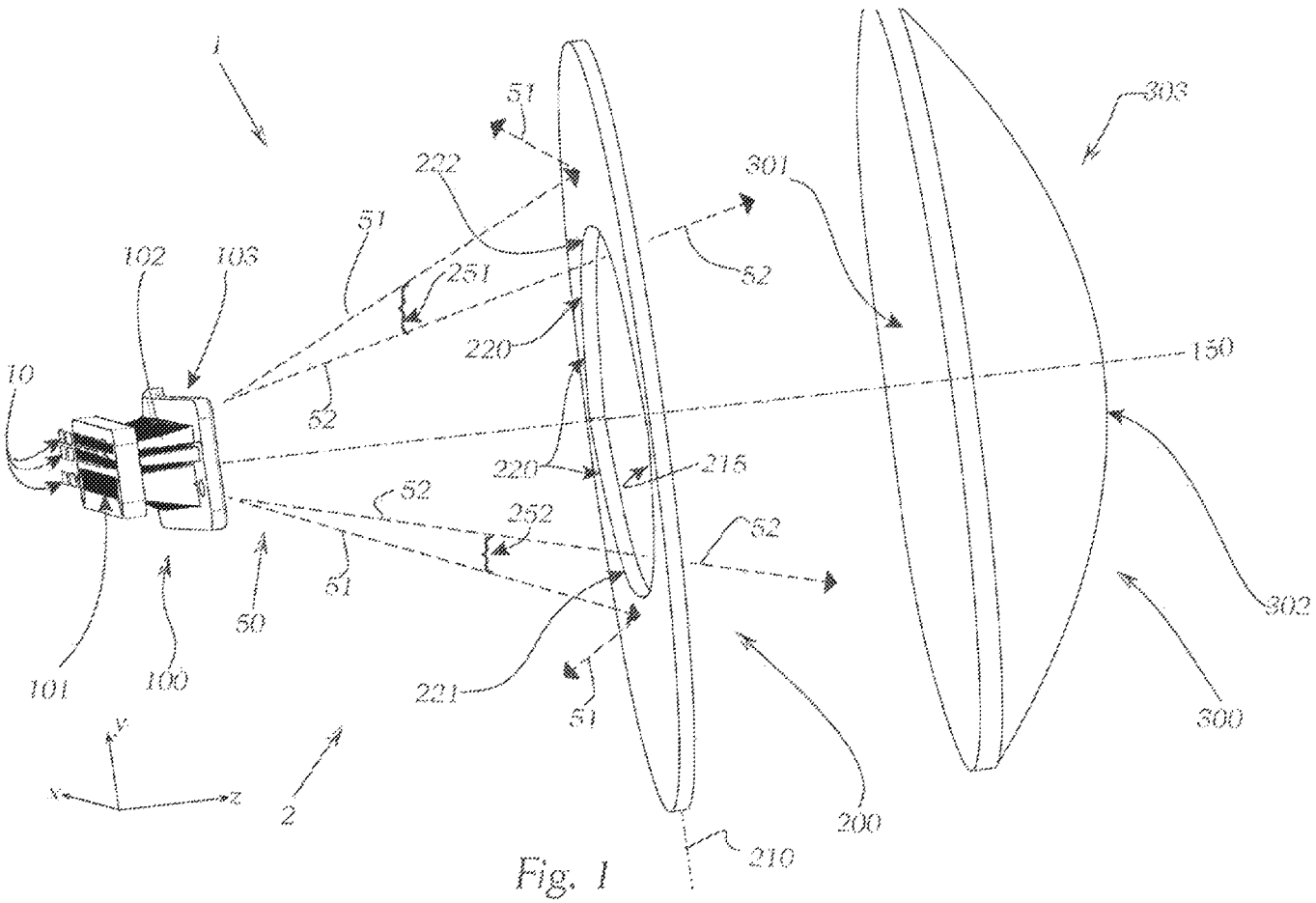
FIG. 1 shows an isometric view of a schematic structure of a first embodiment of a lighting device according to the invention.

FIG. 1 illustrates a schematic structure of a first embodiment of a lighting device 1 according to the invention, having a light module 2 and at least one light emission source 10 or at least one light emission point 10. For that purpose, a primary lens 100, which in this case is connected to the light emission sources 10, comprises a light-conducting ancillary lens 102, which consists of a transparent material, having a plurality of light conductors 102, each having light entry surfaces 101 and light-emitting surfaces 103. Light beams 50, indicated as dashed line, are guided from the light-emitting surfaces 103 of the ancillary lens 102 to a secondary lens 300, which in this case is configured as a projection lens 303 having a lens entry surface 301 and a lens exit surface 302 and which is spaced apart from the primary lens in the direction of an optical longitudinal axis 150. For that purpose, a light-guiding shield 200 is arranged in an aperture plane 210 in the light beam path, wherein aperture edges 220 of the light-guiding shield 200 protrude into the light beam 50 such that blue defining light beams 51 or blue light portions 51 of a light color fringe 250, 251, 252 of the light beam 50 are selectively shaded, while red defining light beams 52 or red light portions 52 pass through the light-guiding shield 200 unimpededly, thus reaching the secondary lens 300 without shading. In the present case, the light-guiding shield 200 is configured as one piece, having an aperture recess 215 as well as a continuous, smoothly continuing aperture edge 220. The left bottom of the drawing shows an outline of the coordinate system used, which will be further referenced below. The z-axis direction is determined by the direction of the optical longitudinal axis 150 of the lighting device 1. The aperture plane 210 is substantially arranged perpendicularly to the optical longitudinal axis 150 or perpendicularly to the z-axis direction.

Figure 2:
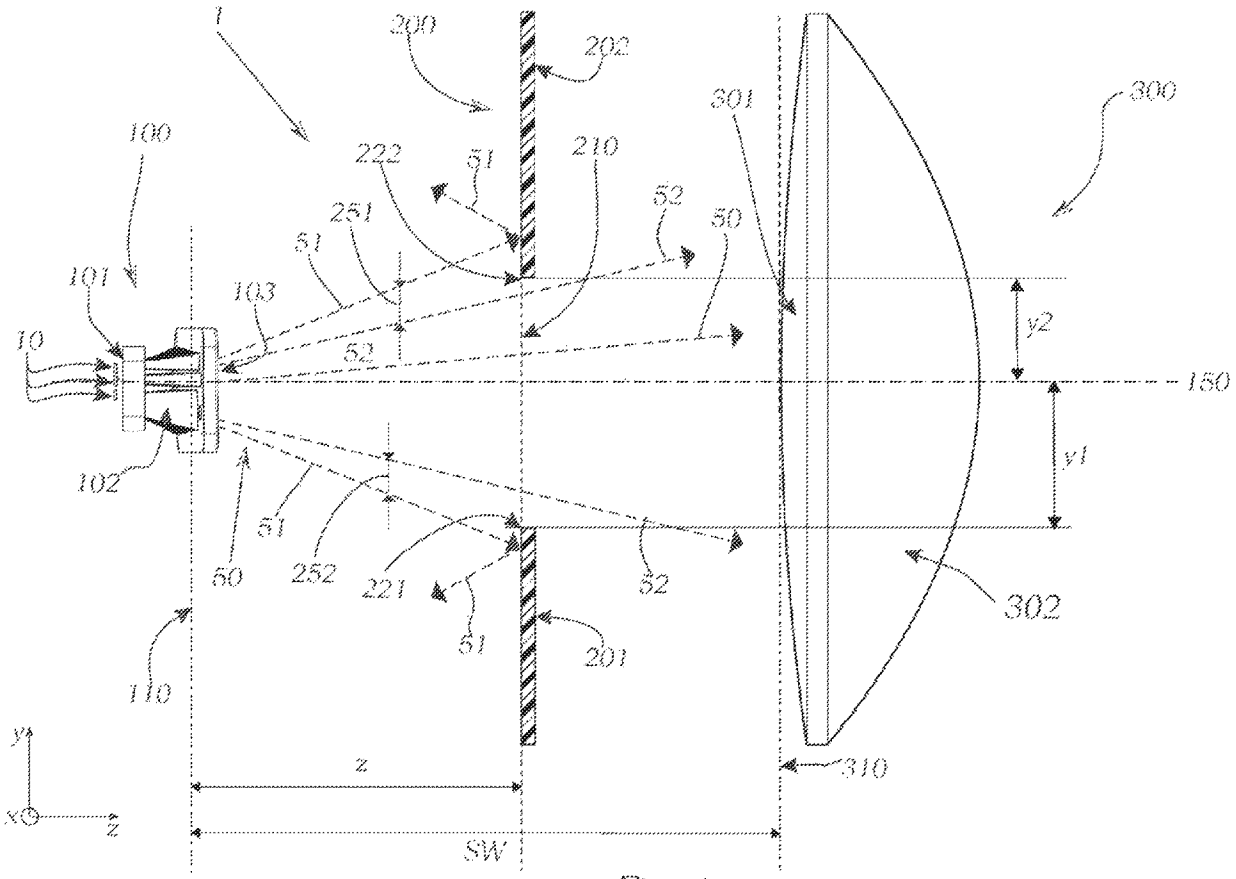
FIG. 2 shows in a partial sectional view from the side a further embodiment of a lighting device according to the invention.

FIG. 2 shows a lighting device 1 according to the invention in a partial sectional view from the side. In this case, the light-guiding shield 200 is a two-piece design, wherein a first aperture part 201 is equipped with a first, smoothly continuing aperture edge 221, and a second aperture part 202 is equipped with a second aperture edge 222. The second aperture edge 222 is also designed without divisions or interruptions so as to be smoothly continuous. The first aperture part 201 and the second aperture part 202, which together form the light-guiding shield 200, are each arranged in the same aperture plane 210. The first aperture part 201 is attached below a horizontal plane through the optical longitudinal axis 150, while the second aperture part 202 provides the aperture edge 222, arranged above the horizontal plane through the optical longitudinal axis 150. The lower or first aperture edge 221 is spaced apart at a normal distance $y_1$ in the negative y-coordinate direction from the optical longitudinal axis 150. The upper or second aperture edge 222 is spaced apart at a normal distance $y_2$ in the positive y-coordinate direction from the optical longitudinal axis 150. Light beams 50, which pass through the light-guiding shield 200, and defining light beams 51, 52, which form a light color fringe 250, are once again indicated as dashed arrows. Blue defining light beams 51 or blue light portions 51 of an upper light color fringe 251 as well as of a lower light color fringe 252 are selectively shaded by the first aperture part 201 or the second aperture part 202. Red defining light beams 52 or red light portions 52 of the upper light color fringe 251 as well as of the lower light color fringe 252 reach the secondary lens past the aperture edges 221, 222 without shading. The aperture plane 210 is arranged at a distance z from a lens focal point plane 110. The entire distance between lens focal point plane 110 and lens apex plane 310 is denoted as focal length SW.

Figure 3:
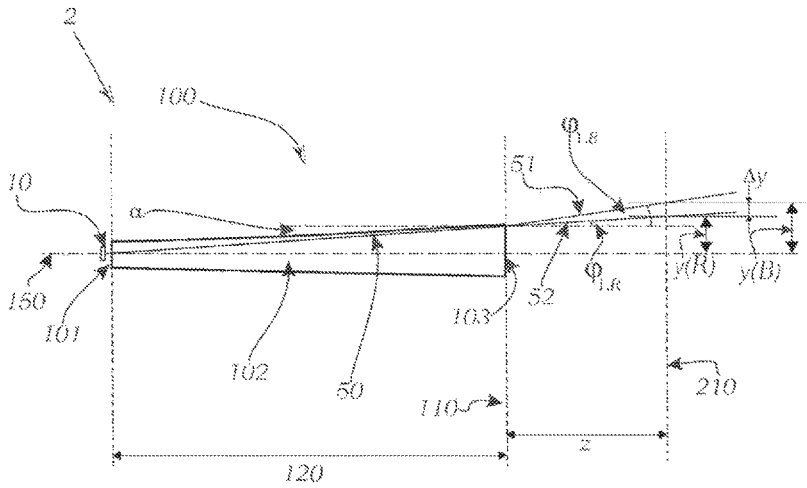
FIG. 3 shows a detailed view from the side of the light beam path of a direct beam in the ancillary lens.

FIG. 3 shows a detailed view of the light beam path of a direct light beam 50 in the light-conducting ancillary lens 102. In this case, the ancillary lens 102 has a length 120 in the direction of the optical longitudinal axis 150. Light generated in the light emission sources 10 reaches the light-conducting ancillary lens 102 at the light-emitting surface 101 and leaves it again at the opposite light-emitting surface 103. The individual light conductors of the light-conducting ancillary lens 102 have, for example, rectangular cross-sections which substantially conically expand from the light entry surface 101 toward the light-emitting surface 103. The ancillary lens 102 or the individual light conductors 102 leas/leave an opening angle $\alpha$ in the direction toward the light-emitting surface 103. The direct light beams 50 conducted by the ancillary lens 102 are split into blue defining light beams 51 and red defining light beams 52 when exiting the light-conducting ancillary lens 102 in the area of the light color fringe. The comparatively short-wave blue radiation or the blue light portion 51 is refracted more strongly than the comparatively long-wave red radiation or the red light portion 52. An exit angle $\varphi_{1,B}$ between the optical longitudinal axis 150 and the blue defining light beam 51 is thus greater than an exit angle $\varphi_{1,R}$ between the optical longitudinal axis 150 and the red defining light beam 52. A normal distance $y_{(B)}$ of the blue defining light beam 51 from the optical longitudinal axis 150, which is measured in the aperture plane 210, is also greater than a normal distance $y_{(R)}$ of the red defining light beam 52 from the optical longitudinal axis 150. The greater a differential distance $\Delta y$ between the red and blue defining light beams 51, 52, measured as normal distance to the optical longitudinal axis 150 in the aperture plane 210, the greater the distance z of the aperture plane 210 from the plane 110 through the lens focal point. The differential distance $\Delta y$ further depends on the material selection of the light-conducting ancillary lens 102, as is illustrated in the subsequent FIGS. 5 to 7.

Figure 4:
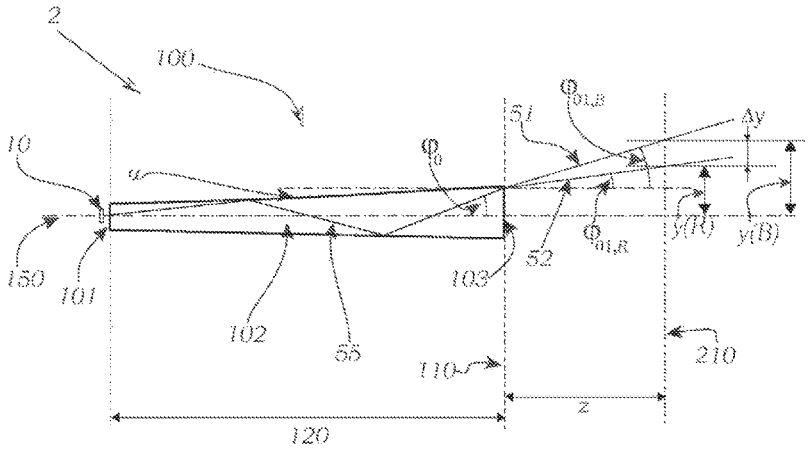
FIG. 4 shows a detailed view from the side of the light beam path with a twice redirected light beam in the ancillary lens.

FIG. 4 shows a schematic detailed view of the light beam path of a twice-redirected light beam 55 in the ancillary lens 102. The redirected light beam 55 exits at the light-emitting surface 102 of the ancillary lens 102 at an exit angle $\varphi_0$ relative to the direction of the optical longitudinal axis 150. In the area of the light color fringe, the blue defining light beams 51 or the blue light portion 51 are once again refracted more strongly than the red defining light beams 51 or the red light portion 52. An exit angle $\varphi_{01,B}$ between the optical axis 150 and the blue defining light beam 51 is once again greater than an exit angle $\varphi_{01,R}$ between the optical axis 150 and the red defining light beam 52. The light-guiding shield (not depicted) is positioned with its aperture edge in the aperture plane 210 such that the aperture edge is arranged at a normal distance to the optical longitudinal axis 150, which lies between the normal distance $y_{(B)}$ of the blue defining light bean 51 and the normal distance $y_{(R)}$ of the red defining light beam 52. In the beam path of a twice-redirected light beam 55 shown in FIG. 4, the differential distance $\Delta y$ between the red and blue defining light beams 51, 52 is somewhat greater than is the case in the beam path of a direct light beam 50 shown in FIG. 3.

A person skilled in the art thus understands that, depending on whether the optically active aperture edges are positioned by means of the differential distance $\Delta y$ of the direct light beams 50 or the light beams 55 already redirected in the light-conducting ancillary lens 102, a shading of red defining light beams is also possible to a slight extent. For the positioning of the aperture edges, it is thus necessary to find an optimum between a preferably complete shading of the blue defining light beams and a preferably unimpeded aperture passage of the red defining light beams.

FIGS. 5 to 7 each show as diagram representation for different materials of the light-conducting ancillary lens 102 the course of the differential distance $\Delta\gamma$ between blue 51 and red. 52 defining light beams as a function of the exit angle $\varphi$ between the optical longitudinal axis 150 and the corresponding defining light beam 51, 52. FIG. 5 shows the courses of the differential distance $\Delta\gamma$ for a light conductor 102 made of polymethyl methacrylate (PMMA), wherein the data series for different distances z were determined at 10-mm, 50-mm, and 80-mm distance from the lens focal point plane or the primary lens 100. It can be seen that at a greater distance z of 80 mm from the primary lens, the differential distance Δγ is greater than with the same exit angle φ at a shorter distance z. For example, for a light conductor made of PMMA at a distance z of 80 mm and an exit angle φ of 20°, the differential distance Δγ is approximately 0.4 mm.

In FIG. 6, in which the courses of the differential distance Δγ for a light conductor 102 made of silicon were determined, wherein the data series are also shown for different distances z at 10-mm, 50-mm, and 80-mm distance from the lens focal point plane or the primary lens 100, the differential distance Δγ, for example, is approximately 0.3 mm at a distance z of 80 mm at an exit angle φ of 20°.

FIG. 7 illustrates the courses of the differential distance Δγ for a light conductor 102 made of polycarbonate (PC). Once again, the data series for different distances z at a distance of 10 mm, 50 mm, and 80 mm from the lens focal point plane or primary lens 100 are shown. For example, for a light conductor made of polycarbonate at a distance z of 80 mm and an exit angle γ of 20°, the differential distance Δγ is approximately 1.0 mm.

A comparison of the three examined materials PMMA, silicon, and PC shows that a light conductor made of polycarbonate (PC), due to the comparatively great differential distance Δγ between exiting blue and red defining light beams is particularly suitable in a lighting device according to the invention to selectively shade interfering blue defining light beams in combination with a light-guiding shield downstream in beam direction.

FIG. 8 shows a so-called "PixelLite" light module 2 with an aperture position 210 of the light-guiding shield 200 at half a focal length SW. In this case, the aperture plane 210 is thus arranged in the direction of the optical longitudinal axis 150 exactly centered between the plane 110 through the lens focal point and the lens apex plane 310.

FIG. 9 shows a diagram representation of the course of the selection criterion Δ(R−B) as a function of the distance z of the light-guiding shield 200 from the lens focal point plane 110 for determining a suitable aperture position 210 in the beam path between the primary lens 100 and the secondary lens 300. For that purpose, for a specific selected distance z of the light-guiding shield 200 from the lens focal point plane 110, a difference Δ(R−B) of the relative difference between a red light portion R, shaded by the light-guiding shield 200 and the red light portion R in the light beam 50 continuing without the light-guiding shield in the light beam 50, and the relative difference between a blue light portion B shaded by the light-guiding shield 200 and the blue light portion B not shaded by the light-guiding shield in the light beam is determined through color sensor measurements. With iteration of the distances z of the light-guiding shield 200 and variation of the normal distance of the aperture edge 220 in x-coordinate direction or y-coordinate direction, each measured from the optical longitudinal axis 150, the course shown in FIG. 9 is determined exemplary for a specific measuring arrangement. In case of a positive difference Δ(R−B), an increased blue light portion B is shaded, and in case of a negative difference Δ(R−B), an increased red light portion R is shaded by the light-guiding shield 200. In the depicted embodiment, an aperture position with a distance z of 20 mm to 25 mm must advantageously be selected in order to achieve a selective shading of the blue light portion B and to ensure a high efficiency of the overall system. The difference Δ(R−B) is 0.1 to 0.2, wherein the distance z and the difference Δ(R−B) are connected directly proportionally. In case of a greater shading, red light portions R are also shaded, and the overall efficiency thus decreases or the measured difference Δ(R−B) shows negative values.

FIG. 10 shows an alternative position of a color-correcting light-guiding shield 200 as part of an ancillary lens holder 105. The light-guiding shield is integrated in the primary lens 100 and together, they are attached to the primary lens holder.

FIG. 11 shows at an angle from above the color-correcting light-guiding shield 200 shown in FIG. 10 as part of the ancillary lens holder 105. The aperture plane 210 of the light-guiding shield 200 is arranged within a light-emitting cone 500 with a boundary edge 510.

FIG. 12 shows in a frontal view of the arrangement shown in FIG. 11, wherein the aperture edges 221, 222 are indicated as dashed lines. Each of the aperture edges 221, 222 is shaped as a freeform curve 240.

FIG. 13 shows the primary lens holder 105 as partial sectional view. The aperture edges 221, 222 in the form of a freeform curve 240 are formed by the primary lens holder 105. The light-guiding shield 200 is thus integrated in the primary lens holder 105.

FIG. 14 shows—similarly to FIG. 3—in a detailed view from the side the shading of defining light beams 51, 52 of a light beam 50 directly guided in the ancillary lens 102. However, contrary to FIG. 3, FIG. 14 also shows an aperture part 202 of a light-guiding shield 200. A blue defining light beam 51 of the light color fringe 251 is shaded by the light-guiding shield 200, while a red defining light beam 52 passes through the aperture plane 210 without shading, thus contributing advantageously to the overall efficiency of the lighting device 1.

LIST OF REFERENCE SIGNS

1 Lighting device
2 Light module
10 Light emission source or light emission point
50 Light beam
51 Blue defining light beam or blue light portion
52 Red defining light beam or red light portion
55 Redirected light beam
100 Primary lens
101 Light entry surface of the ancillary lens
102 Light conductor, individual light-conducting ancillary lens
103 Light-emitting surface of the ancillary lens
105 Primary lens holder
110 Plane through the lens focal point
120 Length of the ancillary lens
150 Optical longitudinal axis
200 Light-guiding shield
201 First aperture part
202 Second aperture part
210 Aperture plane
215 Aperture recess
220 Aperture edge
221 First or lower aperture edge or aperture edge section
222 Second or upper aperture edge or aperture edge section
240 Freeform curve
250 Light color fringe (light beams as dashed line)
251 Upper light color fringe (light beams as dashed line)
252 Lower light color fringe (light beams as dashed line)
300 Secondary lens
301 Lens entry surface

302 Lens exit surface
303 Projection lens
310 Lens apex plane
500 Light emission cone
510 Boundary edge of the light emission cone
R. Red light portion
B Blue light portion
SW Focal length, distance between lens focal point plane and lens apex plane
y Normal distance to the optical axis
Δy Differential distance between defining light beams
z Distance between lens focal point plane and aperture plane
α Opening angle of the ancillary lens
φ Exit angle between optical axis and defining light beam
$\varphi_0$ Angle of incidence in case of multiple reflection in the ancillary lens

The invention claimed is:

1. A lighting device (1) for a motor vehicle headlight, the lighting device comprising:

a light module (2) with at least one light emission source (10);

a primary lens (100) and a secondary lens (300), wherein said primary lens (100) comprises at least one light-conducting ancillary lens (102) which is designed to direct a light beam (50) captured by the at least one light emission source (10) through at least one light-emitting surface (103) of the at least one light-conducting ancillary lens and on to the secondary lens (300) arranged downstream along an optical longitudinal axis (150), and wherein the secondary lens (300) is designed to image a light distribution, which forms on the at least one light-emitting surface (103) of the at least one light-conducting ancillary lens, in an area in front of the lighting device (1); and at least one light-guiding shield (200) for shading a light color fringe (250) arranged between the primary lens (100) and the secondary lens (300), wherein the at least one light-guiding shield (200, 201, 202) is configured to form an optically active first aperture edge (221) for a lower light color fringe (252) and an optically active second aperture edge (222) for an upper light color fringe (251), and the optically active first and second aperture edges (220, 221, 222) form a continuous, smoothly continuing aperture edge that is arranged in such a manner in the light beam (50) that blue defining light beams (51) of the light color fringe (250, 251, 252) are configured to be selectively shaded.

2. The lighting device (1) of claim 1, wherein the optically active first and second aperture edges (220, 221, 222) are each arranged in such a manner in the light beam (50) that red defining light beams (52) reach the secondary lens (300) without shading.

3. The lighting device (1) of claim 2, wherein the optically active first and second aperture edges (220, 221, 222) protrude into the light beam (50) between the blue defining light beams (51) and the red defining light beams (52) of the light color fringe (250, 251, 252).

4. The lighting device (1) of claim 1, wherein the at least one light-guiding shield (200, 201, 202) is arranged substantially perpendicularly to the optical longitudinal axis (150) in an aperture plane (210).

5. The lighting device (1) of claim 1, wherein the at least one light-guiding shield (200) is designed as one piece, having an aperture recess (215) which forms a continuous optically active aperture edge (220) comprising the optically active first aperture edge (221) for the lower light color fringe (252) and the optically active second aperture edge (222) for the upper light color fringe (251), wherein the continuous optically active aperture edge (220) in a mounted position encompasses the optical longitudinal axis (150).

6. The lighting device (1) of claim 1, wherein the at least one light-guiding shield (201, 202) has a two-piece design, wherein a first aperture part (201) with the optically active first aperture edge (221) and a second aperture part (202) with the optically active second aperture edge (222) are arranged on opposite sides of the optical longitudinal axis (150).

7. The lighting device (1) of claim 6, wherein the first aperture part (201) and the second aperture part (202) are arranged in different aperture planes (210) which are spaced apart from one another along the optical longitudinal axis (150).

8. The lighting device (1) of claim 1, wherein at least one of the optically active first and second aperture edges (220, 221, 222) is a freeform curve (240).

9. The lighting device (1) of claim 1, wherein the at least one light-guiding shield (200, 201, 202) is spaced apart along the optical longitudinal axis (150) from a lens focal point plane (110) at a distance (z) of 10% to 90% of a focal length distance (SW) between the lens focal point plane (110) and a lens apex plane (310) of the secondary lens (300).

10. The lighting device (1) of claim 9, wherein the distance (z) of the at least one light-guiding shield (200, 201, 202) from the lens focal point plane (110) is configured to be determined by color sensor measurements and/or color simulation calculations as difference Δ (R−B) of a relative difference between a red light portion (R) shaded by the at least one light-guiding shield (200, 201, 202) and a red light portion (R) continuing without the at least one light-guiding shield in the light beam (50), and a relative difference between a blue light portion (B) shaded by the at least one light-guiding shield (200, 201, 202) and a blue light portion (B) continuing without the at least one light-guiding shield in the light beam (50), wherein in case of a positive difference Δ(R−B), an increased blue light portion (B) is shaded, and in case of a negative difference Δ(R−B), an increased red light portion (R) is shaded by the at least one light-guiding shield (200, 201, 202).

11. The lighting device (1) of claim 10, wherein when the distance (z) of the at least one light-guiding shield (200, 201, 202) from the lens focal point plane (110) is 20 mm to 25 mm, the difference Δ(R−B) has a value of 0.1 to 0.2.

12. The lighting device (1) of claim 1, wherein the at least one light-guiding shield (200) is mounted on a primary lens holder (105) together with the primary lens (100).

13. The lighting device (1) of claim 1, wherein the at least one light-guiding shield (200) is integrated in the primary lens (100).

14. The lighting device (1) of claim 1, wherein a differential distance (Δy) between the blue defining light beam (51) and the red defining light beam (52) is transversal to the optical longitudinal axis (150), depending on a distance (z) in the optical longitudinal axis (150) and the material of the at least one light-conducting ancillary lens (102).

15. The lighting device (1) of claim 1, wherein the secondary lens (300) comprises a projection lens (303) having a lens entry surface (301) and a lens exit surface (302).

16. The lighting device (1) of claim 1, wherein the lighting device (1) is designed to generate a low beam or high beam distribution.

17. A motor vehicle headlight having at least one lighting device (1) according to claim 1.

18. A motor vehicle having at least one motor vehicle headlight which comprises at least one lighting device according to claim 1.

19. The lighting device (1) of claim 9, wherein the at least one light-guiding shield (200, 201, 202) is spaced apart in the optical longitudinal axis (150) from the lens focal point plane (110) at the distance (z) of 30% to 70% of the focal length distance (SW) between the lens focal point plane (110) and the lens apex plane (310) of the secondary lens (300).

20. The lighting device (1) of claim 9, wherein the at least one light-guiding shield (200, 201, 202) is spaced apart in the optical longitudinal axis (150) from the lens focal point plane (110) at the distance (z) of 50% of the focal length distance (SW) between the lens focal point plane (110) and the lens apex plane (310) of the secondary lens (300).

* * * * *